US007987619B2

(12) United States Patent
McKinney et al.

(10) Patent No.: US 7,987,619 B2
(45) **Date of Patent: *Aug. 2, 2011**

(54) SHOE WITH WRITING SURFACE

(76) Inventors: Kelye A. McKinney, Lincoln, CA (US); James E. Mulligan, Roseville, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/655,537

(22) Filed: Dec. 30, 2009

(65) Prior Publication Data

US 2010/0107441 A1 May 6, 2010

Related U.S. Application Data

(63) Continuation of application No. 11/403,423, filed on Apr. 12, 2006, now Pat. No. 7,661,208.

(51) Int. Cl.
*A43B 23/00* (2006.01)

(52) U.S. Cl. ..... 36/136; 36/112

(58) Field of Classification Search ..... 36/25 R, 36/136, 112, 98, 45

See application file for complete search history.

(56) References Cited

U.S. PATENT DOCUMENTS

| | | | | |
|---|---|---|---|---|
| 2,394,900 | A | 2/1946 | Clisby | |
| 4,115,933 | A | 9/1978 | Chiaramonte, Jr. | |
| 4,627,110 | A | 12/1986 | Tengs | |
| 4,697,362 | A | 10/1987 | Wasserman | |
| 5,136,726 | A | 8/1992 | Kellin | |
| 5,253,368 | A | 10/1993 | Blake | |
| 5,596,821 | A | 1/1997 | Solo | |
| 5,845,422 | A | 12/1998 | Valteau, III | |
| 5,921,003 | A | 7/1999 | Kim | |
| 5,921,008 | A | 7/1999 | Ruff | |
| 5,996,261 | A | 12/1999 | Nelson | |
| 6,050,007 | A | 4/2000 | Angelieri | |
| 6,094,844 | A | 8/2000 | Potts | |
| 6,243,974 | B1 | 6/2001 | Schaj | |
| 6,308,438 | B1 | 10/2001 | Throneburg | |
| 6,308,445 | B1 | 10/2001 | Porraro | |
| 6,421,832 | B1 | 7/2002 | Ondrejko | |
| 6,434,870 | B1 | 8/2002 | Fanjoy | |
| 6,684,543 | B2 | 2/2004 | Fernau | |
| 7,089,691 | B1 | 8/2006 | Silvera | |
| 7,661,208 | B2 * | 2/2010 | McKinney et al. | 36/136 |
| 2005/0016031 | A1 | 1/2005 | Ruff | |
| 2005/0022431 | A1 | 2/2005 | Spitzer-Cohn | |

* cited by examiner

*Primary Examiner* — Marie Patterson
(74) *Attorney, Agent, or Firm* — Heisler & Associates

(57) ABSTRACT

A shoe is provided with a writing surface so that temporary expressive indicia can be applied to the shoe. The writing surface is preferably in the form of a side surface of the shoe extending between a tread and a foot contacting surface of the shoe. The side surface is preferably formed of patent leather compatible with a dry erase marker provided as a writing implement. In a most preferred form of the invention, the shoe includes a bore which acts as a housing for the marker or other writing implement to conveniently store the writing implement when not in use. The bore or other housing also keeps the writing implement fresh by sealing the writing implement within the bore when not in use, especially when the writing implement is a dry erase marker.

8 Claims, 2 Drawing Sheets

SHOE WITH WRITING SURFACE

CROSS-REFERENCE TO RELATED APPLICATIONS

This application is a continuation of U.S. patent application Ser. No. 11/403,423, filed on Apr. 12, 2006 now U.S. Pat. No. 7,661,208.

FIELD OF THE INVENTION

The following invention relates to shoes and other footwear. More particularly, this invention relates to shoes which have surfaces thereof which can be written upon by the wearer or others, preferably in a temporary and repeatable fashion.

BACKGROUND OF THE INVENTION

Many individuals enjoy expressing themselves through their clothing and through non-clothing adornment. This ornamentation can be located many different places and can take various different forms. For instance, ornamentation can be placed upon a shirt, trousers, or a hat. Also, such ornamentation can be provided directly upon the individual's body, such as through tattoos (both temporary and permanent) the decoration of fingernails and toenails, and through an almost limitless variety of different wearable and directly applyable expressive elements.

The expression can be subtle or explicit. For instance, a subtle form of expression can occur merely through the selection of patterns and colors to be provided on the clothing or directly applied to the body. More explicit expression can occur through utilization of commonly recognized symbols or the writing of words. For instance, t-shirts are often adorned with written messages or symbols which can be recognized by others and thus convey a message. Similar explicit symbols or words can be otherwise worn by an individual, such as through utilization of tattooing methods, nail finishing, etc.

Many individuals desire to be highly expressive but dislike the permanence associated with printing on clothing with a single message or permanently applying a tattoo. Such individuals may wish to be expressive in different ways, such as by conveying different messages through different words or different symbols at different times. Such individuals might also desire to at times express little or no message, or only provide a subtle decoration, rather than an explicit message. With the permanence of printed material on clothing, or tattoos, such an individual has less flexibility, or is required to maintain a large wardrobe for all of the different expression that the individual may wish to display. Accordingly, a need exists for wearable expression which can be readily modified to match the expression desired for the individual.

Many individuals enjoy wearing unique footwear as a form of expression. By wearing such unique footwear, a form of non-verbal expression is afforded to the individual. Surveys often report the large numbers of pairs of shoes owned by individuals, and particularly women. Purchase, storage and maintenance of such a large inventory of shoes creates its own set of problems.

In at least one prior art instance, the ability to convey some form of customized message has been combined with footwear, such as in the Spitzer-Cohn decoratable shoe which is the subject of U.S. Patent Application Publication No. US2005/0022431. This decoratable shoe has a chalkboard marking surface on side portions of the shoe so that a user can write with chalk directly upon this side surface of the shoe.

While such a decoratable shoe generally allows an individual to provide a customized message or other expression directly on the shoe, this decoratable shoe is not entirely satisfactory in achieving all of the above outlined purposes. In particular, the Spitzer-Cohn decoratable shoe does not provide any convenient location for storage of the chalk. One would thus typically be only able to modify the decoratable shoe at a location where chalk is available. Often an individual has time where the individual is waiting for some other activity to begin and the individual is free to apply some expressive element visually on the shoe. If the shoe could provide a container for such a writing implement, the user would be able at any time to modify the shoe as desired.

Furthermore, chalk and a chalkboard surface are not entirely satisfactory. When water is encountered, the chalk readily washes off. Chalk is typically somewhat muted in appearance, making it difficult to read any words or other symbols clearly unless a relatively large amount of space is provided. Furthermore, the best chalk writing surfaces are rather rigid, and are less compatible with shoe construction. Thus, compromise must be made either in utilizing more rigid materials than desired in constructing the shoe or in materials which are less able to hold the chalk and provide high contrast for good visibility when messages or other expression are applied with chalk.

Accordingly, a need exists for a shoe with a writing surface that can provide a clear high contrast message or other expression, and which can also contain a writing implement within the shoe for convenient storage and ready availability when an individual wishes to modify the appearance of the shoe.

SUMMARY OF THE INVENTION

With this invention, a shoe is provided with a writing surface which is compatible with a writing implement, preferably in the form of a dry erase marker. In particular, applicant has experimented with different materials and has found that white patent leather provides a high contrast surface which is also able to be wiped after writing thereon with a dry erase marker, and the dry erase ink easily wipes completely away. Furthermore, patent leather material is highly compatible with shoe construction, being substantially non-water absorbent, able to repel dirt and debris for easy cleaning, sufficiently flexible to provide adequate comfort to the wearer and is amenable to mass production shoe manufacture. Also, the patent leather material, being a common shoe manufacturing material already, provides the wearer with the option of providing no message and having footwear which is innocuous when not provided with any particular expression, such as when the wearer wishes to not present any such particular expression.

Furthermore, with this invention at least one bore is provided which extends into a core between a foot contacting surface of the shoe and a tread of the shoe. This bore is sized to receive a dry erase marker or other writing implement therein. The bore is preferably sized so that at least a portion of the bore has a friction fit with a portion of the dry erase marker so that a tip of the dry erase marker remains isolated from an outside environment and avoids drying out. One way to provide this friction fit is to embed a dry erase marker cap within the core and aligned with the bore so that the tip of the marker snaps into the cap when it is stored in the bore.

The shoe can have the writing surface configured in many different ways. Most preferably, the writing surface is in the form of a side surface extending from the tread up to the foot contacting surface on lateral sides of the shoe, and most particularly on an outer side of the shoe where any writing is most visible while the shoe is being worn. An upper is provided on the shoe which preferably merely provides the function of covering an upper portion of the wearer's foot and helping to hold the shoe onto the wearer's foot. As an alternative, the writing surface can extend up onto the upper, and the upper can fully or partially enclose the foot, so that the writing surface can extend up over upper portions of the wearer's foot also.

While patent leather has been shown to be particularly effective, other materials could be selected in alternative embodiments of this invention. The shoe can be configured with a single bore for a single writing implement or with multiple bores, so that writing implements having different colors can be stored within a single shoe. Where two shoes are each provided with three bores, up to six colors can be provided for the writing of full color messages, emblems or other expression (i.e. lines, polka dots, patterns, etc.) upon the writing surface of the shoe.

OBJECTS OF THE INVENTION

Accordingly, a primary object of the present invention is to provide a shoe with a writing surface thereon so that a writing implement can write a temporary message or other expression onto the shoe.

Another object of the present invention is to provide a shoe with both a writing surface and a housing to at least partially house a writing implement within or on the shoe.

Another object of the present invention is to provide a shoe with a variable appearance.

Another object of the present invention is to provide a method for modifying the appearance of a shoe.

Another object of the present invention is to provide a shoe formed of a material which is compatible with dry erase markers for temporary decoration of the shoe.

Another object of the present invention is to provide a shoe which is fun to wear and fun to play with by decorating the shoe in a limitless variety of ways by writing upon a writing surface thereof.

Another object of the present invention is to provide a shoe which can be written upon and which maintains a sufficient comfort that the wearer can wear the shoe and the shoe can perform adequately while displaying a message or other expression.

Other further objects of the present invention will become apparent from a careful reading of the included drawing figures, the claims and detailed description of the invention.

DESCRIPTION OF THE PREFERRED EMBODIMENT

Figure 1:
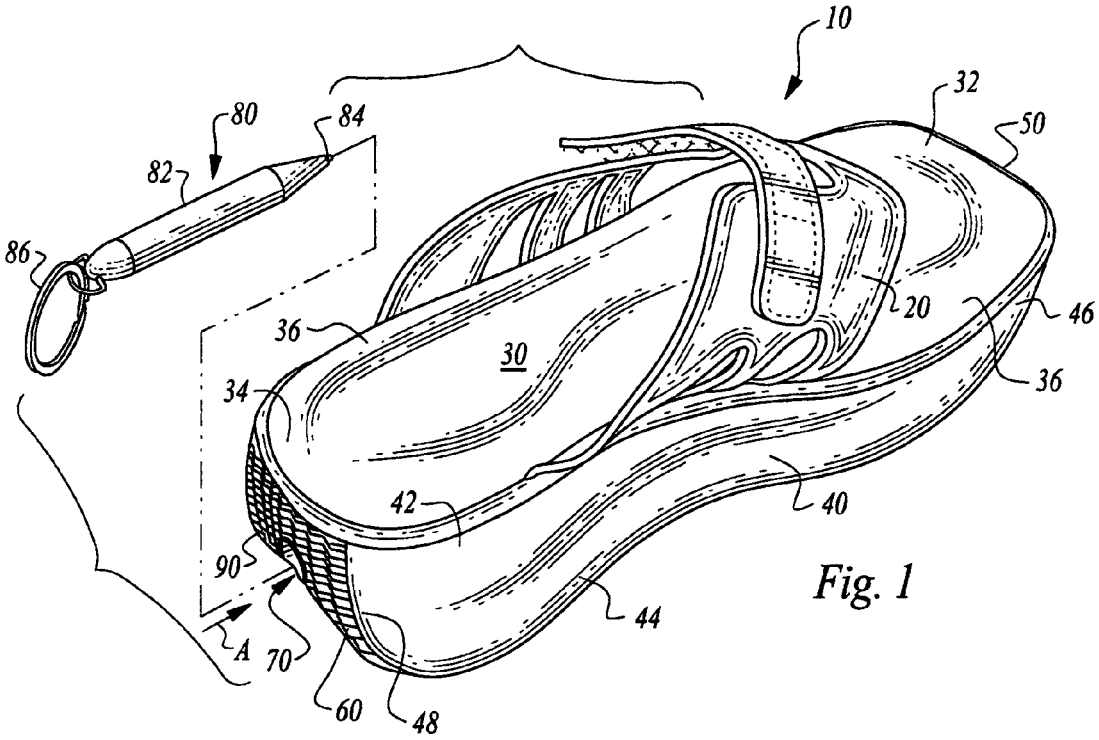
FIG. 1 is a perspective view of a shoe according to a preferred embodiment of this invention and with a writing implement shown exploded out of a bore that is provided for housing the writing implement within the shoe.

Referring to the drawings, wherein like reference numerals represent like parts throughout the various figures, reference numeral 10 is directed to a shoe (FIG. 1) which includes a writing surface which can be written upon with a writing implement such as a dry erase marker 80 (FIG. 1). In this way, various different decorations D (FIG. 2) can be written upon the shoe 10 so that a variety of different expressive indicia can be temporarily applied to the shoe 10. When the decoration D is to be changed or no expression is desired for the shoe 10, the decoration D can be removed, such as through utilization of a cloth C to wipe the decorations D off of the writing surface.

Figure 2:
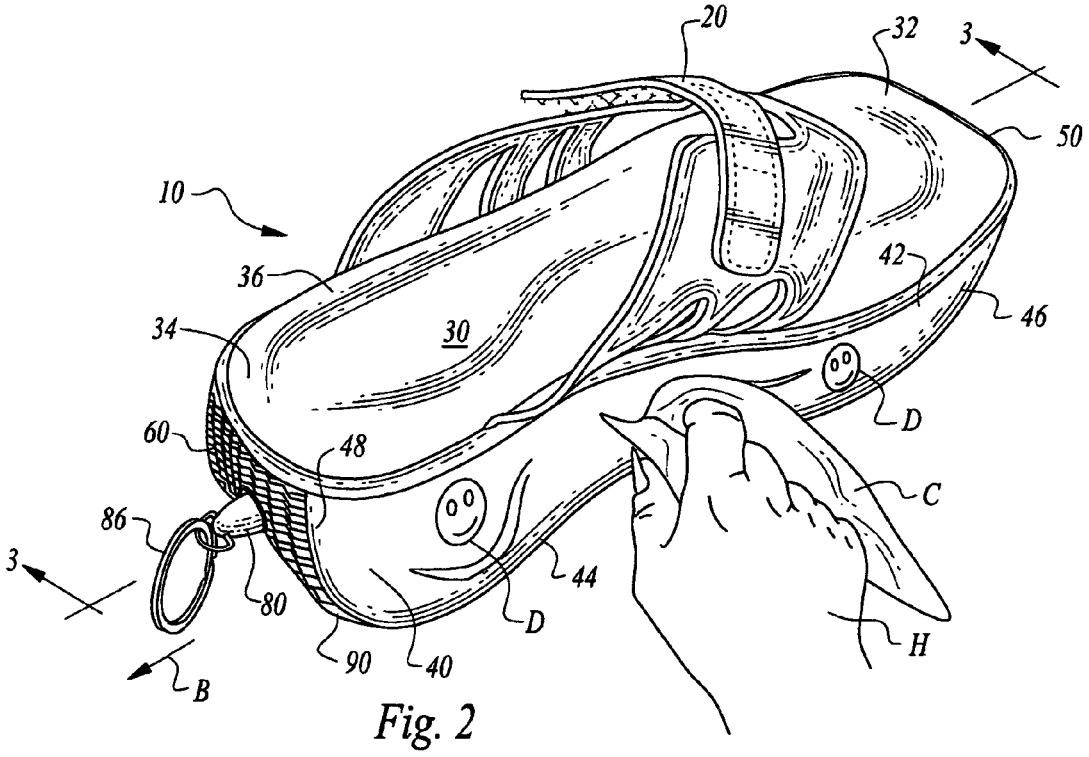
FIG. 2 is a perspective view similar to FIG. 1, but with the writing implement stored within the housing of the shoe, and with decorations applied to a side surface of the shoe and in the process of being wiped off, according to a method of this invention.

In essence, and with particular reference to FIGS. 1 and 2, basic details of the shoe 10 of the preferred embodiment are described. The shoe 10 generally includes an upper 20 which is constructed to hold the shoe 10 onto a foot of a wearer. Below the upper 20, a foot contacting surface 30 is provided to support a foot of a wearer. A side surface 40 extends down from the foot contacting surface 30 to a tread 90. This side surface 40 and the foot contacting surface 30 extend from a toe end 50 to a heel end 60. A bore 70 is preferably provided extending into a core 75 between the foot contacting surface 30 and the tread 90. This bore 70 acts as a housing for storing of the marker 80 or other writing implement within the shoe 10.

More specifically, and with particular reference to FIGS. 1 and 2, details of the various structures of the shoe 10 are described, according to this preferred embodiment. The upper 20 is shown in the general form of a thong style sandal with the upper 20 attached to other portions of the shoe 10 near lateral sides of the foot contacting surface 30. The upper 20 also is shown attaching directly to the foot contacting surface 30 through a thong element located particularly to reside between a big toe and other toes of the foot of the wearer. However, the upper 20 could have a limitless variety of different configurations and still operate according to this invention.

The upper 20 could be made from a common material with the side surface 40 or from a separate material. The upper 20 could be open as shown or substantially or entirely enclosed. The upper 20 can essentially have any configuration desired, provided that the upper 20 provides the general function of keeping the shoe 10 upon the foot of the wearer.

The foot contacting surface 30 defines that portion of the shoe 10 upon which the foot directly rests when the shoe 10 is being worn. This foot contacting surface 30 is elongate and extends from a forward edge 32 to a rear edge 34 and is bounded laterally by side edges 36. The foot contacting surface 30 could be planar, but most preferably is contoured generally to match a form of a lower surface of the foot of the wearer for maximum comfort. This foot contacting surface 30 most preferably is elevated near the rear edge 34 and lowered near the forward edge 32 such that the entire shoe 10 is generally caused to be taller near the rear edge 34 and shorter near the forwarded edge 32.

The foot contacting surface 30 is preferably somewhat soft and flexible so that the foot of the wearer can be fully supported even when feet of different specific geometries are being supported by the foot contacting surface 30. Also, the foot contacting surface 30 could optionally be made from a common material with that of the side surface 40 which defines the writing surface in the preferred embodiment of this invention. Most preferably, however, the foot contacting surface 30 does not form any portion of the writing surface.

The shoe 10 includes a pair of side surfaces 40, with only one of the side surfaces 40 shown in the figures, but with the opposite side surface being of a similar form. In particular, the side surfaces 40 are preferably oriented vertically and project downwardly from the side edges 36 of the foot contacting surface 30. These side edges 40 preferably provide the primary writing surface for the shoe 10 of this invention. This side surface 40 is preferably sufficiently tall between the tread 90 and the foot contacting surface 30 so that relatively large and distinct expressive elements in the form of symbols, written letters, patterns, polka dots, stripes, or other indicia can be depicted on the side surface 40 and be readily seen by others.

For instance, near the heel end 60, the side surface 40 is preferably approximately two and one-half inches tall. Near the toe end 50, the side surface 40 preferably maintains a height of at least one and one-half inches except as the side surface 40 is approaching the toe end 50, where the side surface 40 can taper down to a point. This side surface 40 is shown in this embodiment as extending from the tread 90 to the foot contacting surface 30 and then terminating. As an alternative, the side surface 40 could extend up past the foot contacting surface 30 and the side surface 40 could transition into a portion of the upper 20, or could otherwise continue upwardly separate from the upper 20 to provide a larger writing surface.

The side surface 40 extends from an upper edge 42 preferably adjacent a foot contacting surface 30 down to a lower edge 44 preferably adjacent the tread 90. The side surface 40 also extends from this front edge 46 adjacent the toe end 50 to a back edge 48 adjacent the heel end 60.

The writing surface is preferably formed of white patent leather. The inventor's experimentation has shown that white patent leather can be written upon with standard dry erase markers and provides a high contrast image. When the dry erase ink is to be erased, a user's fingers, or a paper or fabric cloth C can be readily utilized to wipe away the dried dry erase ink. After such wiping occurs, no residual image remains upon the patent leather forming the side surface 40 or other portions of the writing surface of the shoe 10. Further experimentation by the inventor or others may reveal other materials which provide at least adequate performance with dry erase markers. While a preferred embodiment for this invention calls for formation of the writing surface from white patent leather, this invention should not be so limited to just this one material or color, unless particularly so restricted by the claims of this invention.

By way of example, black patent leather could form the writing surface and colored (non-black) and white dry erase markers 80 could be used. One unique and desirable combination is to use fluorescent dry erase inks on black patent leather for a particularly striking display. Other colors of patent leather could also be used.

Figure 3:
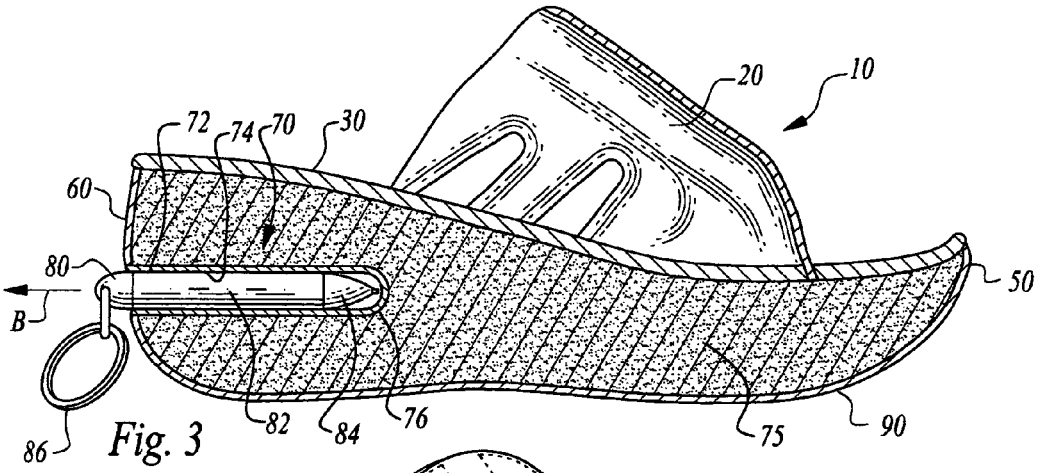
FIG. 3 is a full sectional view of that which is shown in FIG. 2 and illustrating interior details of the shoe of the preferred embodiment of this invention.
Figure 4:
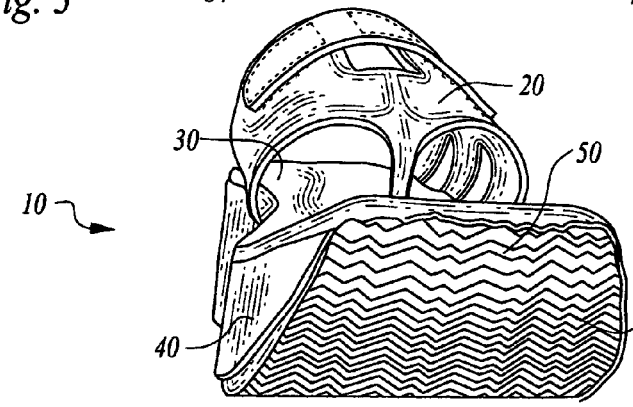
FIG. 4 is a front elevation view of that which is shown in FIG. 2.

With particular reference to FIGS. 1-3, details of the bore 70 or other housing and marker 80 or other writing implement of this invention are described, according to the preferred embodiment. Most preferably, the tread 90 extends up over the heel end 90 all the way up to the foot contacting surface 30. As an alternative, the side surface 40 could wrap around the heel end 60 of the shoe 10 to join the side surfaces 40 on opposite sides of the shoe 10 together at the heel end 60.

The bore 70 provides a preferred form of housing and acts as a means to couple the marker 80 or other writing implement to the shoe 10. Other coupling means could be complemental fasteners on the shoe 10 and marker 80, or cylindrical sleeves attached to the shoe 10, rather than embedded in the core 75.

The bore 70 preferably includes an entrance 72 located adjacent the heel end 60 and midway between the two side surfaces 40, and approximately midway between the foot contacting surface 30 and portions of the tread 90 which underlie the foot contacting surface 30. This bore 70 extends substantially horizontally into the core 75 approximately midway between the foot contacting surface 30 and the tread 90. The bore 70 preferably has a cylindrical wall 74 defining the bore 70 from the entrance 72 adjacent the heel end 60 to an inner end 76 where the bore 70 preferably terminates.

Where the writing implement is a dry erase marker 80, the bore 70 is preferably particularly configured to keep the dry erase marker 80 from drying out. In particular, the cylindrical wall 74 near the inner end 76 can be sized with a diameter which causes a friction fit with the marker 80 between a barrel 82 of the marker 80 and a tip 84 of the marker 80. Thus, a very small chamber, akin to a cap for the marker 80, is provided adjacent the inner end 76 of the bore 70 which is caused to be airtight by interface between the cylindrical wall 74 and the barrel 82 of the marker 80. In this way, the dry erase marker 80 remains "fresh" and ready for use until all of the dry erase ink within the marker 80 has been depleted. In one embodiment an actual dry erase marker can be embedded within the core 75 at the inner end 76 of the bore 70 to provide this seal.

Most preferably, a pull ring 86 is also located on the marker 80 to most conveniently allow the marker 80 to be pulled out of the bore 70 for use of the marker 80.

The preferred marker 80 is a "dry erase" type of marker that contains ink that dries quickly on contact with air, and which turns to powder and can be readily wiped off of appropriate smooth surfaces. One such dry erase marker suitable for this invention is provided by Boone International of Corona, Calif. under the trademark REWRITABLES.

The bore 70 provides a preferred form of housing for the marker 80. If the writing implement is of a different type than the dry erase marker 80, it is less important that a seal exist within the bore 70 to preserve freshness of the marker 80. However, for retention purposes only, it is still desirable that the writing implement be retained within the bore 70 except when a user wishes to remove the writing implement from the bore 70.

The bore 70 could be provided at various different locations on the shoe 10, such as entering into the core 75 from the toe end 50, or entering into the core 75 through the lateral side surfaces 40 of the shoe 10. Most preferably however, the bore 70 passes into the shoe 10 from the heel end 60, where a maximum amount of depth of the core 75 is provided and so that the side surfaces 40 can be preserved without interruption of the writing surfaces for the shoe 10.

Figure 5:
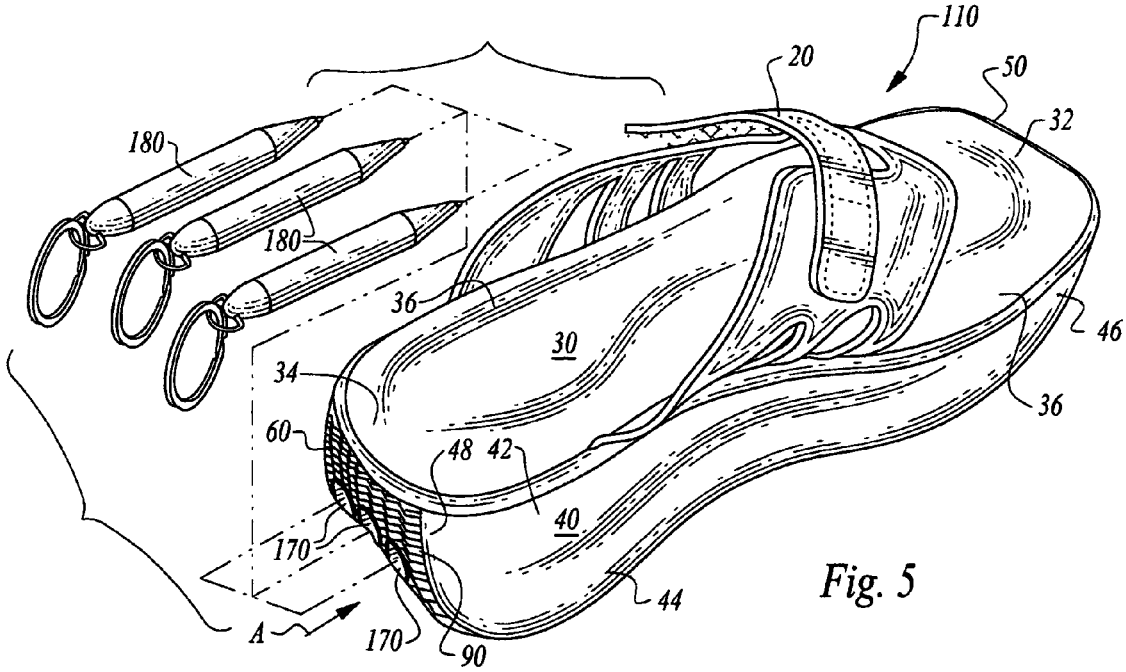
FIG. 5 is a perspective view of an alternative embodiment of the shoe of this invention with three separate bores for housing three separate writing implements within the alternative shoe of this invention.

With particular reference to FIG. 5, details of an alternative shoe 110 are described according to an alternative embodiment of this invention. The alternative shoe 110 is similar to the shoe 10 of the preferred embodiment (FIGS. 1-4) except that triple bores 170 are provided adjacent the heel end 60. These triple bores 170 each contain a different one of triple markers 180 therein. With the configuration of the alternative shoe 110, three markers 180 having different colors can be provided within a single shoe 110.

When a pair of similar shoes 110 are provided, six markers having different colors can be provided. For instance, the markers could be purple, blue, green, yellow, orange and red and all be contained within a single pair of shoes. Other colors could also alternatively be provided, such as black, gold or brown (or white if a non-white writing surface is provided). With the alternative shoe 110, the triple bores 170 are preferably each horizontal and parallel with each other and have their entrances extending out of the heel end 60 of the alternative shoe 110.

While triple bores 170 are shown, it would also be conceivable to provide only two bores, or more than three bores, particularly if the alternative shoe 110 is larger in size or if the markers 180 are smaller in diameter. It is also conceivable that the bores 170 could be provided in multiple separate rows at different elevations so that still further numbers of bores could be provided for more markers and more different colors within the alternative shoe 110.

In use and operation, and with particular reference to FIGS. 1-3, basic details of the use of the shoe 10 of the preferred embodiment of this invention are described. Initially and with reference to FIG. 2, the marker 80 would be contained within the bore 70. When a user wishes to add expression to the writing surface of the shoe 10, the user removes the marker 80, by translation along arrow B, out of the bore 70. The free marker 80 (FIG. 1) can then be utilized to write upon the side surface 40 or other writing surface of the shoe 10. When the marker 80 or other writing implement is no longer being used, it can be conveniently stored and kept fresh by reinserting the marker 80 back into the bore 70 (along arrow A of FIG. 1). Once the shoe 10 has been decorated with decorations D (FIG. 2) these decorations D can be readily removed, such as by utilizing a cloth C (or merely wiping with a user's fingers) and with a hand H wiping motion against the writing surface to remove the dry erase ink off of the writing surface. A different decoration D can then be provided or the shoes 10 can be left undecorated.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A method for writing on a shoe, the method including the steps of:

selecting a shoe having an upper portion; a foot contacting surface adapted to support a foot thereon; a tread below the foot contacting surface and adapted to rest upon the ground; a dry erase ink writing implement; a writing surface coupled to the shoe and adapted to be written upon by the writing implement; the writing surface adapted to retain dry erase ink thereon; the writing surface adapted to release dry erase ink therefrom when wiped; the writing surface providing at least part of the upper portion; the upper portion adapted to at least partially enclose a wearer's foot; said upper portion and said writing surface being flexible to a degree sufficient to flex and maintain comfort for a wearer's foot;

writing dry erase ink on the writing surface providing at least part of the upper portion with the writing implement; and wiping off the dry erase ink.

2. The method of claim 1 including the further step of repeating said writing step on the writing surface after said wiping off step.

3. The method of claim 1 wherein the writing surface is patent leather.

4. The method of claim 1 wherein the upper portion is adapted to substantially entirely enclose a wearer's foot.

5. The method of claim 1 including the further step of removably attaching the writing implement to the shoe.

6. A kit for practicing a method for writing on a shoe, the kit comprising in combination:

a shoe having an upper portion;

a foot contacting surface adapted to support a foot thereon;

a tread below the foot contacting surface and adapted to rest upon the ground;

a dry erase ink writing implement;

a writing surface coupled to the shoe and adapted to be written upon by the writing implement;

the writing surface adapted to retain dry erase ink thereon;

the writing surface adapted to release dry erase ink therefrom when wiped;

the writing surface providing at least part of the upper portion;

the upper portion adapted to at least partially enclose a wearer's foot;

said upper portion and said writing surface being flexible to a degree sufficient to flex and maintain comfort for a wearer's foot;

dry erase ink written upon the writing surface with the writing implement; and a wiper adapted to wipe off the dry erase ink from the writing surface.

7. The kit of claim 6 wherein the writing surface is patent leather.

8. The kit of claim 6 wherein the upper portion is adapted to substantially entirely enclose a wearer's foot.

* * * * *